United States Patent [19]

Saito et al.

[11] Patent Number: 5,049,935

[45] Date of Patent: Sep. 17, 1991

[54] ELECTROPHOTOGRAPHIC IMAGE FORMING APPARATUS WITH REVERSAL DEVELOPMENT

[75] Inventors: Hitoshi Saito, Machida; Masami Eda, Itami, both of Japan

[73] Assignee: Minolta Camera Kabushiki Kaisha, Osaka, Japan

[21] Appl. No.: 652,775

[22] Filed: Feb. 8, 1991

[30] Foreign Application Priority Data

Feb. 10, 1990 [JP] Japan ..... 2-30978

[51] Int. Cl.[5] ..... G03G 15/02

[52] U.S. Cl. ..... 355/219; 346/160; 355/223; 355/271

[58] Field of Search ..... 355/227, 204, 221, 225, 355/219, 245, 223, 271; 346/160

[56] References Cited

U.S. PATENT DOCUMENTS 4,139,942 1/1979 Nakahata et al. ..... 355/222
4,591,262 5/1986 Oseto et al. ..... 355/221
4,623,243 11/1986 Iijima et al. ..... 355/219
4,757,345 7/1988 Ohashi et al. ..... 355/219
4,914,457 4/1990 Fukatsu et al. ..... 346/160 X

FOREIGN PATENT DOCUMENTS 59-37500 9/1984 Japan .

*Primary Examiner*—Arthur T. Grimley
*Assistant Examiner*—Sandra L. Hoffman
*Attorney, Agent, or Firm*—Willian Brinks Olds Hofer Gilson & Lione

[57] ABSTRACT

An electrophotographic image forming apparatus with reversal development system, wherein a photosensitive member is charged to first polarity by a first charger and then charged to second polarity opposite to the first polarity by a second charger which is provided at downstream side of the first charger with respect to the rotational direction of the photosensitive member prior to an image formation so as to form uniform images regardless of the number of image formation.

7 Claims, 6 Drawing Sheets

ELECTROPHOTOGRAPHIC IMAGE FORMING APPARATUS WITH REVERSAL DEVELOPMENT

BACKGROUND OF THE INVENTION

1. Field of the Invention

The present invention relates to an electrophotographic image forming apparatus, and more specifically relates to an image forming apparatus for forming images with reversal development.

2. Description of the Related Art

Image forming methods using electrophotographic processes have generally found wide use in conventional copying machines, and are also used in printers that use a laser beam to write digital data on a photosensitive member.

Digital printers that form electrophotographic images must use a reversal developing method for character writing wherein the parts of the photosensitive member relative to recording data are exposed by a laser beam. Reversal developing methods develop electrostatic latent images formed on the surface of a photosensitive member charged with a specific polarity by means of a toner having the same polarity when a developing bias voltage VB is applied.

FIG. 1 shows a conventional image forming device using a reversal development method. In the aforesaid conventional device, when the main motor (not shown in the drawing) is switched ON, the cylindrical photosensitive member 1 rotates and the main charger 2, which is a scorotron type charger with an attached grid 2*b*, is simultaneously switched ON so as to charge the surface of photosensitive member 1 with an initial surface electrical potential $V_o$, as shown in the timing chart in FIG. 2.

Thereafter, the charged surface of the photosensitive member I is irradiated by a laser beam or like image light L by means of the exposure means 6 so as to form an electrostatic latent image on the surface of photosensitive member 1. Then, the aforesaid electrostatic latent image is developed into a toner image on the surface of photosensitive member 1 by the developing roller 3 using a reversal development method.

On the other hand, a recording sheet (not shown in the drawing) is taken up from a paper supply device (also not shown in the drawing) and guided to a pair of timing rollers 4, and transported to the transfer charger 5 so as to arrive simultaneously with the toner image with a timing that is coordinated by switching ON the timing rollers 4.

The transfer charger 5 is switched ON with a timing that coincides with the arrival of the recording sheet, and transfers the toner image to the recording sheet by means of an electrical charge having a polarity which is opposite to the polarity of the main charger 2. The operation of the aforesaid devices is controlled by a central processing unit (CPU).

FIGS. 4 and 5 shows the measured values of surface potentials $V_i$ of the image region on the surface of the photosensitive member 1 after exposure to light when each single cycle of image formation with reversal development is repeated. That is, at the beginning of image formation when a relatively few number of images are formed, the value of electric potential $V_i$ of the image portion becomes $V_{ia}$, as shown in FIG. 4 and the difference $\Delta V$ between the developing bias and the electric potential $V_{ia}$ is relatively small. However, the electric potential $V_i$ of the image portion decreases as the number of formed images increases. When a few hundreds of image formation are accomplished, the electric potential of the image region becomes $V_{ib}$, and the difference in the electric potential $\Delta V$ becomes larger. Since the sensitivity of photosensitive member 1 becomes greater as the difference in electric potential $\Delta V$ becomes larger, the photosensitivity of photosensitive member 1 increases as the number of images formed increases, in a process of so-called memory-sensitized high-speed developing.

Particularly when an organic photosensitive member is used, the post-exposure potential $V_i$ of the image portion of the surface of the photosensitive member 1 is greatly reduced as the number of images formed increases, as shown with a broken line in FIG. 6. Therefore, the density of the formed image gradually increases and the image line width becomes gradually thicker, such that uniform images cannot be produced.

As shown in the timing chart in FIG. 3, the main motor and main charger 2 are switched ON so that as the photosensitive member 1 is rotated said member is simultaneously and continuously charged by main charger 2, and, similarly, the exposure means timing rollers 4, transfer charger 5 and the like are sequentially switched ON at set intervals so as to repeatedly form images and develop said images with a reversal development process. In this case, just as in the previously described single-cycle image formation process, the post-exposure potential $V_i$ on the surface of photosensitive member 1 is markedly reduced as the number of formed images increases (refer to FIG. 7), and the previously mentioned disadvantages also occur.

SUMMARY OF THE INVENTION

A main object of the present invention is to provide an electrophotographic image forming apparatus with a reversal development process which eliminates the previously described disadvantages.

A further object of the present invention is to provide an electrophotographic image forming apparatus with a reversal development process which minimizes the gradual increase of image density of the formed images and minimizes the gradual thickening of image line thickness even under repeated image formation, so as to stabilize image uniformity.

These and other objects of the present invention are accomplished by providing an electrophotographic image forming apparatus with reversal development comprising a first charging means for charging the surface of the photosensitive member with a specific polarity, an exposure means for exposing an image on the surface of the photosensitive member so as to form an electrostatic latent image thereon, a developing means for developing with a reversal development process the latent image formed on the surface of the photosensitive member by the exposure means, a second charging means which is disposed downstream from the first charging means with respect to rotational direction of the photosensitive member and which imparts a charge to the surface of the photosensitive member that is opposite in polarity to the change of the first charging means, and a control means for controlling the charging of the photosensitive member by the first charging means at least once prior to image formation as well as controlling charging by the second charging means to charge the surface of the previously charged photosensitive member with another charge having a polarity opposite that of the first charging means without operating the exposure means.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter in comparisons with conventional image forming apparatus and in conjunction with the accompanying drawings.

Figure 1:
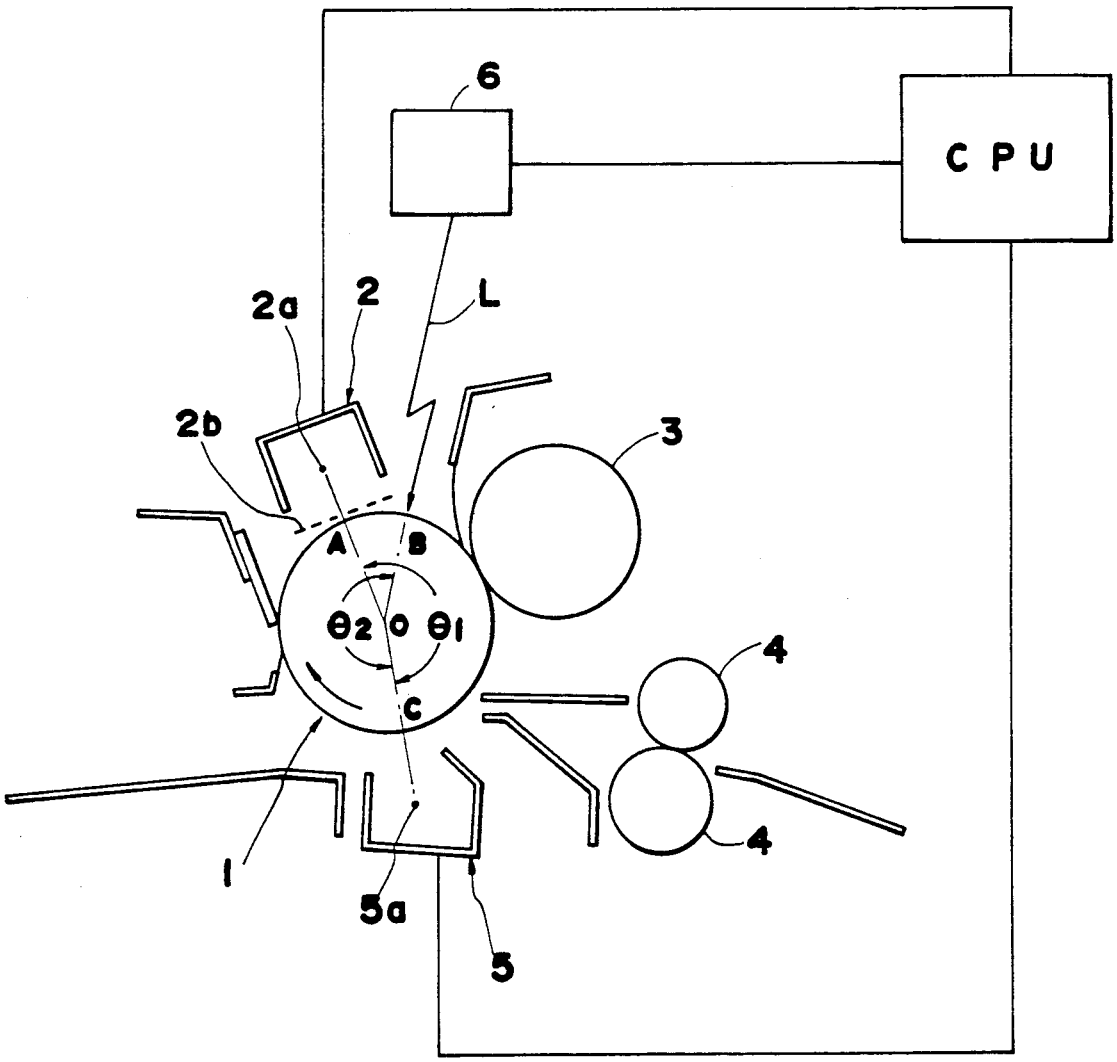
FIG. 1 is a brief section view of the first embodiment of the present invention and a conventional image forming apparatus.
Figure 2:
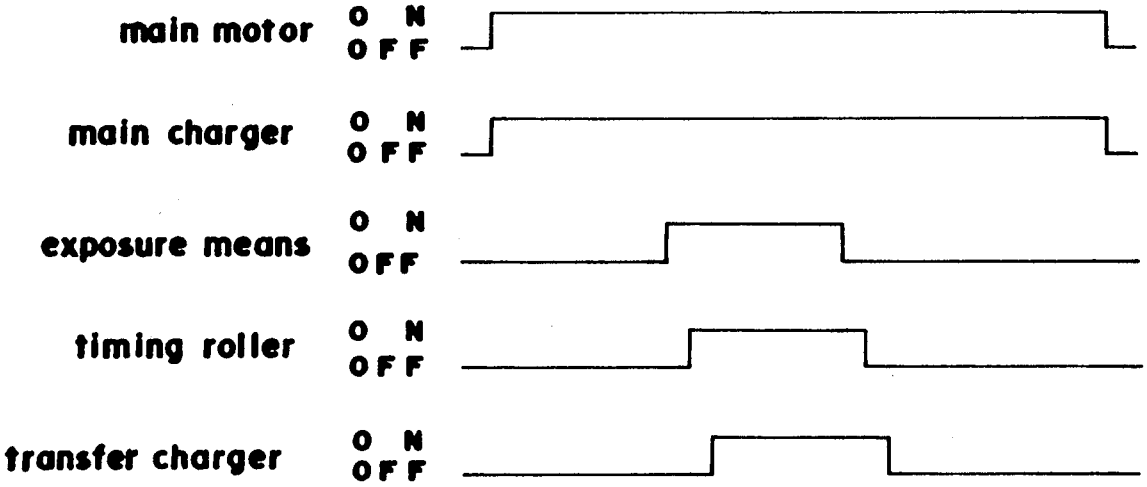
FIG. 2 is a timing chart showing the timing of a single-cycle image forming process performed by a conventional image forming apparatus.
Figure 3:
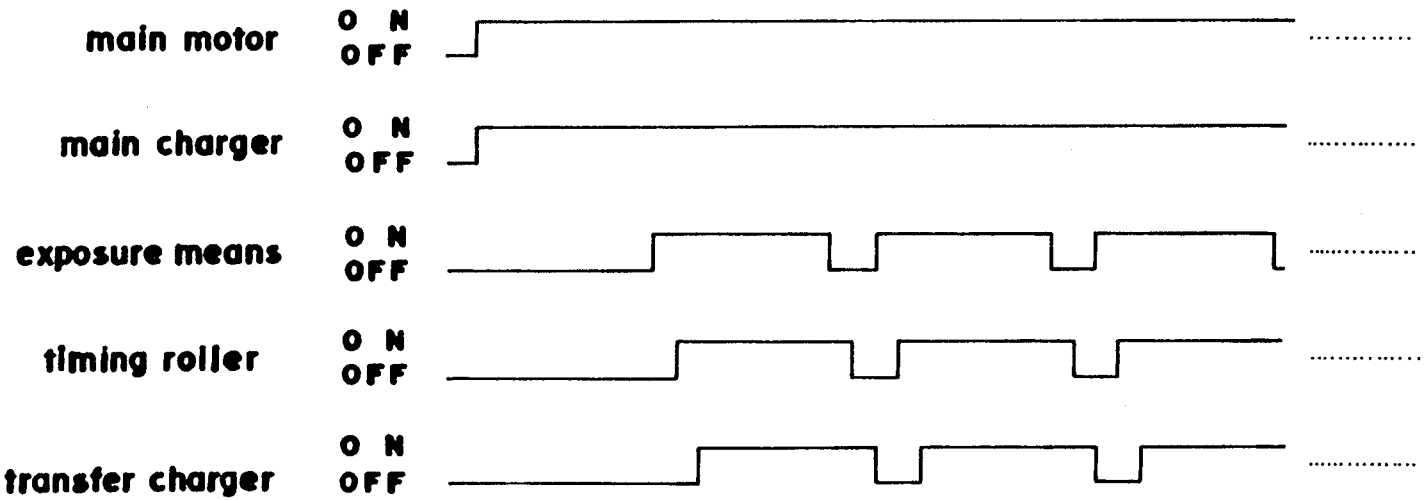
FIG. 3 is a timing chart showing the timing of a continuous image forming process performed by a conventional image forming apparatus.
Figure 4:
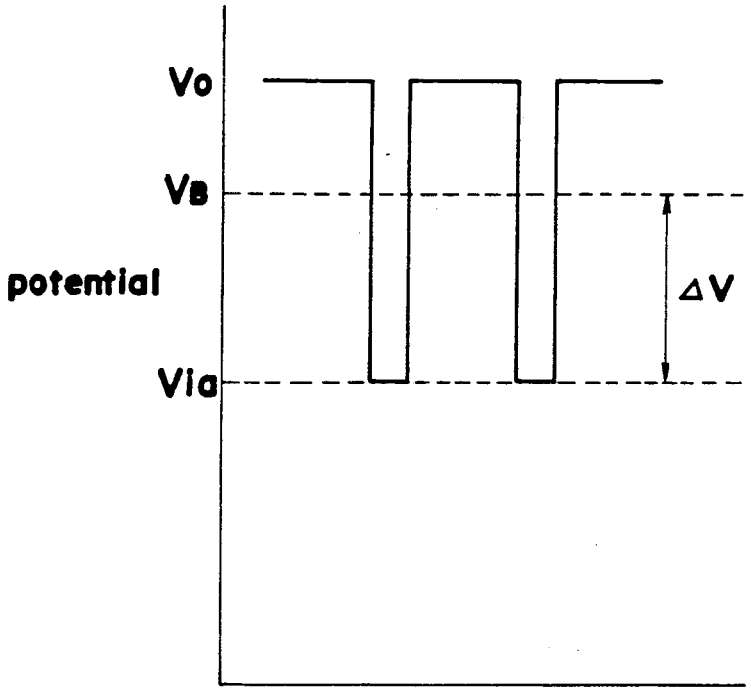
FIG. 4 is a graphical illustration showing the change in electrical potential on the surface of the photosensitive member in the initial image forming process when a single-cycle image forming process is repeated in a conventional image forming apparatus.
Figure 5:
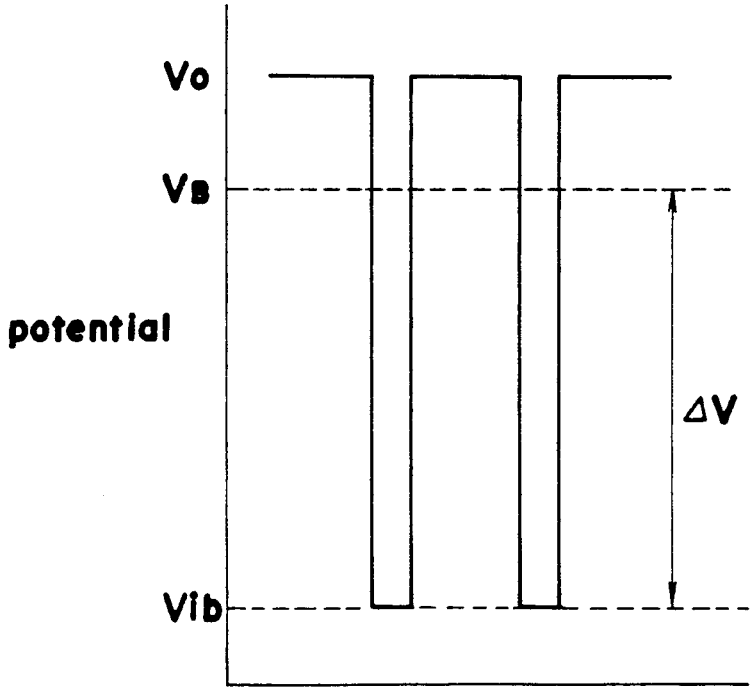
FIG. 5 is a graphical illustration showing the change in electrical potential on the surface of the photosensitive member after the single-cycle image formation is repeated a few hundred times in a conventional image forming apparatus.

The construction of the present embodiment of the invention is identical to that of the conventional image forming apparatus shown in FIG. 1.

Figure 8:
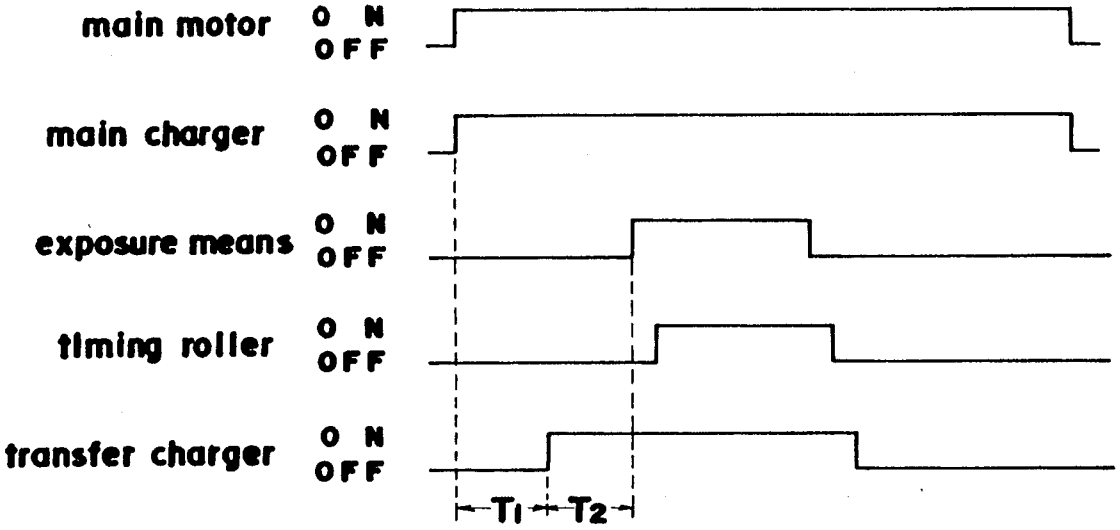
FIG. 8 is a timing chart showing the timing when single-cycle image formation is performed by the image forming apparatus of the embodiment of the invention.

In the image forming apparatus of the present embodiment, control is accomplished by means of a central processing unit (CPU), and the operation of the devices arranged from that of a photosensitive member differs from that of a conventional apparatus. That is, a single image formation is accomplished by the timing shown in the timing chart of FIG. 8, wherein the main motor is switched ON and the photosensitive member is rotated, and the main charger 2 is switched ON so as to impart an electrical charge to the surface of the photosensitive member 1. Then, the portion of the photosensitive member 1 which has been charged by the main charger 2 is irradiated at the exposure position by a laser beam or similar light L emitted by the exposure means 6. Initially, the photosensitive member 1 is rotated, as is, without switching ON the exposure means 6, and at the instant the portion of the photosensitive member 1 that has been charged by the main charger 2 reaches the position of transfer charger 5 said transfer charger 5 is switched ON and an electrical charge of opposite polarity to that of the main charger is imparted from the transfer charger 5 to the previously charged photosensitive member 1.

The timing by which the transfer charger 5 is switched ON is described hereinafter. If the radius of the photosensitive member 1 is designated R (mm), the peripheral speed of the photosensitive member is designated V (mm/sec), the position of the charging wire 2*a* of the main charger 2 relative to the photosensitive member 1 is designated position A, the center of the photosensitive member 1 is designated O, the position of the transfer wire 5*a* of transfer charger 5 relative to the photosensitive member 1 is designated position C, and the angle ∠AOC is designated $\Theta_1$ (radians), then Equation 1 below expresses the time $T_1$ which elapses from the instant the main charger 2 is switched ON until the transfer charger 5 is switched ON.

$$T_1=(R\Theta_1)/(2V) \quad (1)$$

The photosensitive member 1 is again rotated as the transfer charger 5 imparts an electrical charge thereto that has a polarity which is opposite the polarity of the charge of the main charger 2. When the portion of the photosensitive member 1 charged by the opposite polarity charge from the transfer charger 5 reaches the position of the main charger 2, that portion of the surface of photosensitive member 1 is again charged by the main charger 2.

Subsequently, when the photosensitive member 1, which has already been recharged by the main charger 2 in the previously described manner, rotates and reaches the light L exposure position B of the exposure means, said exposure means is switched ON, and the photosensitive member 1 is irradiated by light L so as to accomplish image exposure thereon to form an electrostatic latent image on the surface of the photosensitive member 1.

The timing by which the exposure means is switched ON is described hereinafter. If the position of the transfer wire 5a of transfer charger 5 relative to the photosensitive member 1 is designated position C, the center of the photosensitive member 1 is designated O, the position of light L from the exposure means relative to the photosensitive member 1 is designated exposure position B, and the angle ∠COB is designated $\Theta_2$ (radians), then Equation 2 below expresses the time $T_2$ which elapses from the instant the transfer charger 5 is switched ON until the exposure means is switched ON.

$$T_2=(R\Theta_2)/(2V) \quad (2)$$

After the electrostatic latent image is formed on the surface of the photosensitive member 1 by the exposure means in the previously described manner, toner is supplied from developing roller 3 to the low-charged latent image region on the surface of the photosensitive member 1 by a reversing development process so as to form a toner image on the photosensitive member 1.

The aforesaid toner image is then transferred by the transfer charger 5 onto a recording sheet transported to the transfer position by the pair of timing rollers 4.

The previously described process of single-cycle image formation was repeated numerous times, and the changing state of the post-exposure electrical potential $V_i$ on the image region of the surface of the photosensitive member 1 was measured. The results of these measurements are indicated by the solid line in FIG. 6.

Figure 6:
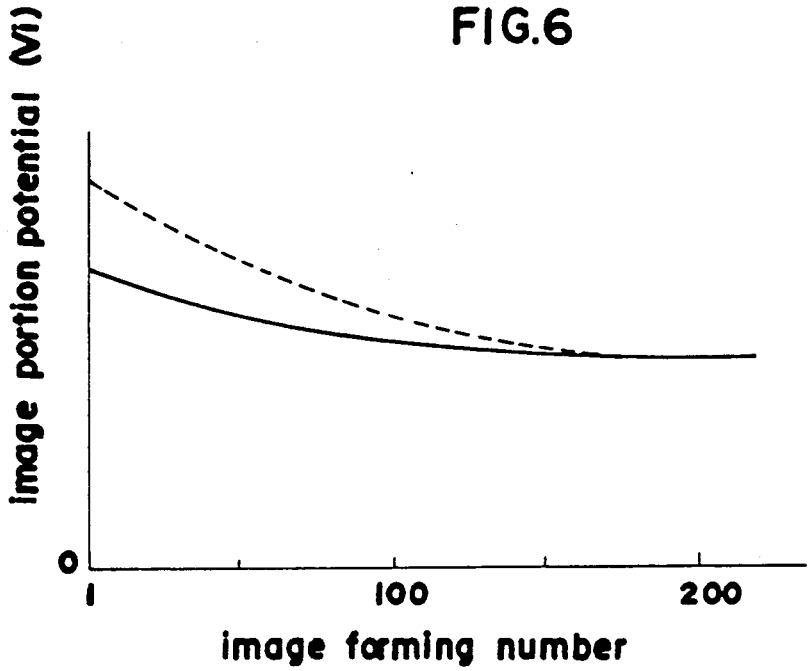
FIG. 6 is a graphical illustration showing the change in post-exposure electrical potential on the surface of the photosensitive member when single-cycle image formation is repeated by the first embodiment of the invention and by a conventional image forming apparatus.

FIG. 6 clearly shows that when single-cycle image formation was repeated numerous times using the image forming apparatus of the above-mentioned embodiment, the post-exposure electrical potential $V_i$ of the image region of the photosensitive member 1 was considerably lower at the initial image formations compared to that of a conventional image forming apparatus. However, the reduction of the electrical potential $V_i$ of the image region of the photosensitive member 1 is very slight as the number of formed images increases.

Thus, in the image forming apparatus of the present embodiment, a high sensitivity is maintained by the photosensitive member 1 from the initial image formations with only slight change in sensitivity of the photosensitive member 1 as image formation is repeated. Therefore, image uniformity is stabilized by minimizing a large increase in sensitivity of the photosensitive member 1 in conjunction with repeated image formation, minimizing a gradual increase in the density of the formed image and minimizing a gradual increase of image line thickness.

Figure 9:
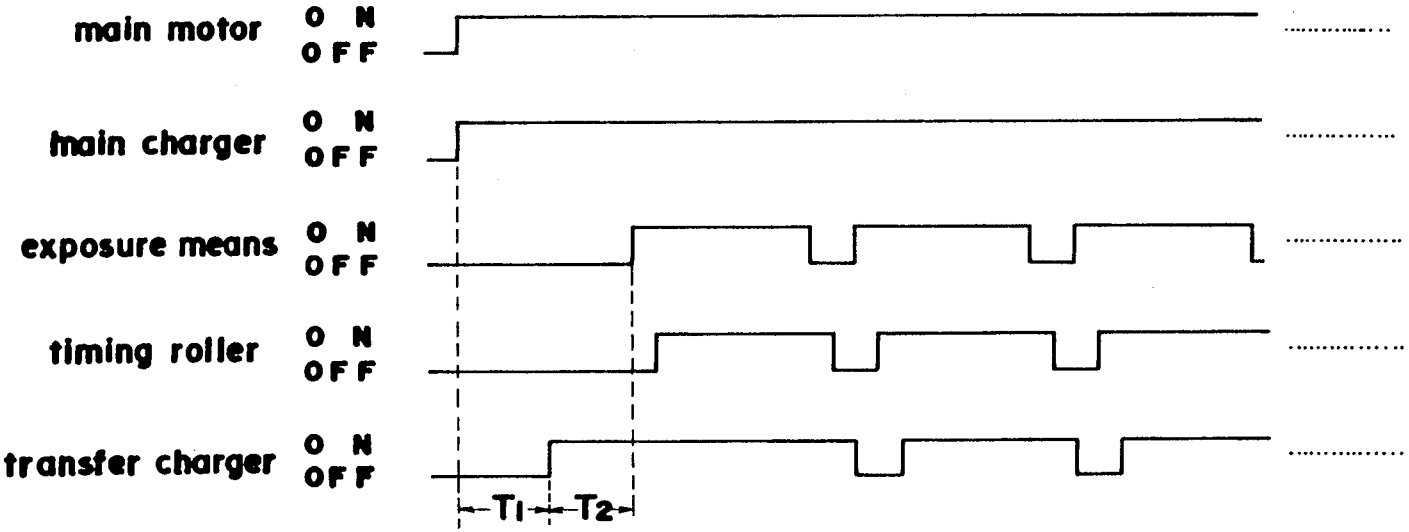
FIG. 9 is a timing chart showing the timing when continuous image formation is performed by the same embodiment of the invention.
Figure 10:
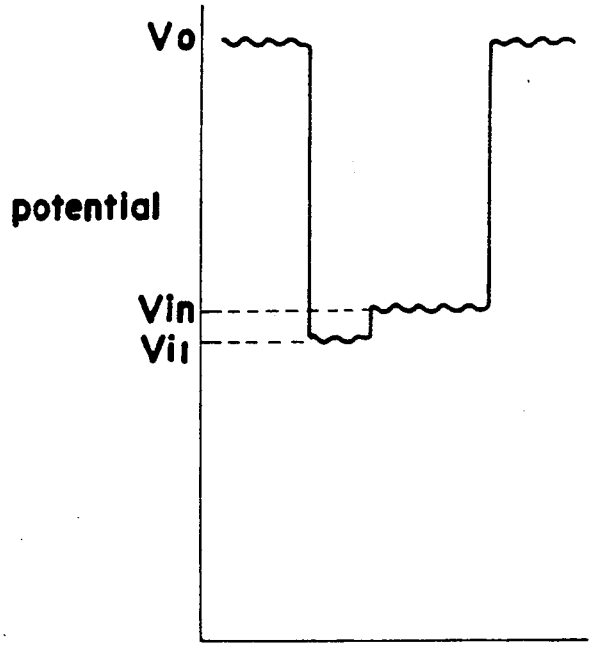
FIG. 10 is a graphical illustration showing the change in the post-exposure electrical potential on the surface of the photosensitive member after the first and on and after the second exposures when image formation is performed by the present embodiment of the image forming apparatus.
Figure 11:
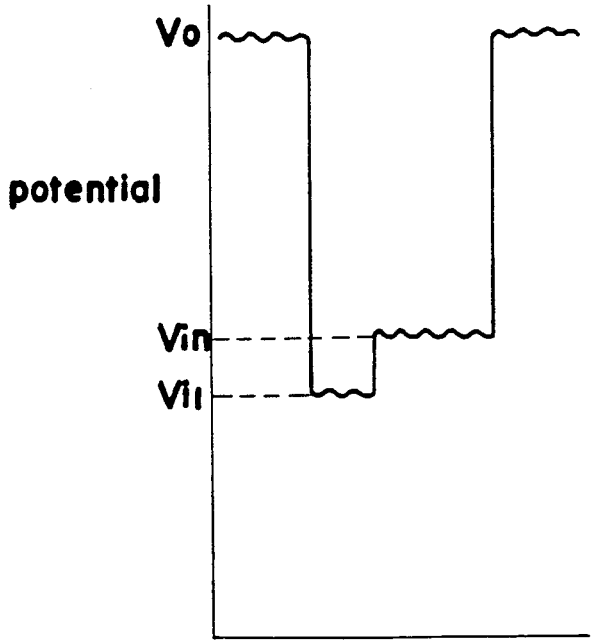
FIG. 11 is a graphical illustration showing the post-exposure electrical potential on the surface of the photosensitive member after the first and on and after the second exposures when the main charger charges those portions of the surface of the photosensitive member which have been previously charged by the transfer charger with an opposite polarity charge so as to accomplish image formation with a reversal development process.

Continuous image formation by the image forming apparatus of the present embodiment is shown in the timing chart in FIG. 9. At the start of image formation, the photosensitive member 1 is charged by the main charger 2, then charged by the transfer charger 5 without image exposure on the photosensitive member 1. Thereafter, continuous image formation is accomplished in the same manner as in conventional image forming apparatus.

Figure 7:
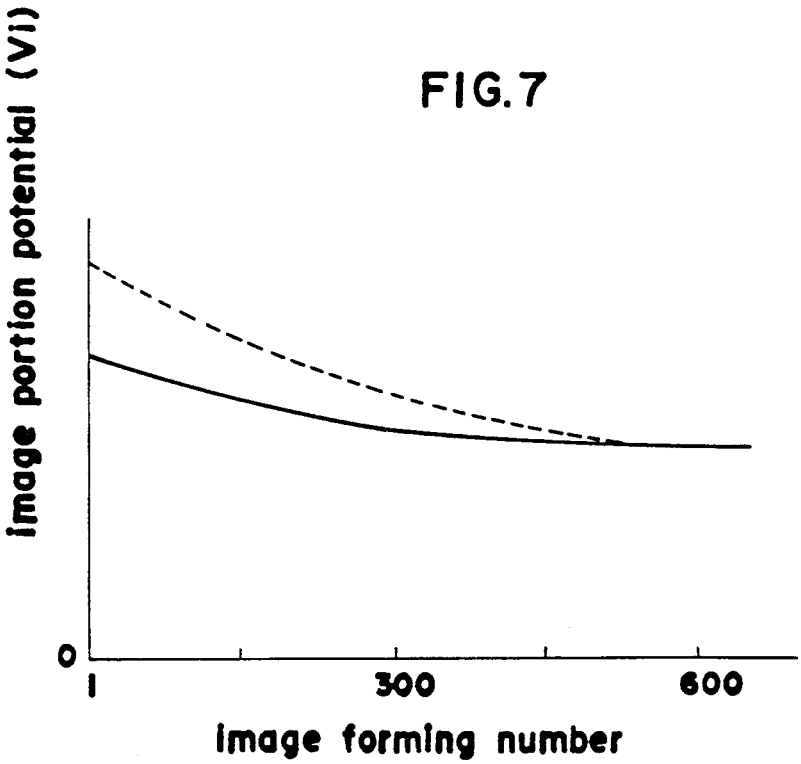
FIG. 7 is a graphical illustration showing the change in post-exposure electrical potential on the surface of the photosensitive member when continuous image formation is performed by the embodiment of the present invention and a conventional image forming apparatus.

In this instance, the solid line in FIG. 7 indicates the measured change in post-exposure electrical potential $V_i$ in the image region of the photosensitive member 1. Just as in the previously described numerous repetitions of single-cycle image formation, the post-exposure potential V of the image region of the photosensitive member 1 was considerably lower from the initial image formations compared to that of a conventional image forming apparatus, such that the reduction of the electrical potential $V_i$ of the image region of the photosensitive member 1 is very slight as the number of formed images increases.

Accordingly, continuous image formation with reversal development by the image forming apparatus of the present embodiment maintains a high sensitivity of the photosensitive member 1 from the start of image formation. Since the sensitivity of the photosensitive member 1 changes only slightly, the production of uniform images can be stabilized.

In the present embodiment, before image formation is accomplished the photosensitive member 1 is charged by the main charger 2, then the transfer charger 5 is switched ON the instant the charged surface region of the photosensitive member 1 reaches the position of transfer charger 5 which applies a charge having the opposite polarity to the charge applied by the main charger 2. Thereafter, the initial surface potential $V_o$ of the photosensitive member 1 is applied by the main charger 2 and image formation is accomplished, such that the difference between the first post-exposure potential $V_{i1}$ of the image region of the photosensitive member 1 and the second and subsequent post-exposure potentials $V_{in}$ of the image region is less than 10 V. Thus, image irregularities and defects between the first formed image and subsequent formed images are prevented.

On the other hand, if before image formation the main charger 2 and the transfer charger 5 are simultaneously switched ON, and regions of the photosensitive member 1 are charged by the main charger 2 and regions are previously charged with an opposite polarity by the transfer charger 5. Thereafter, the photosensitive member 1 is charged by the main charger 2 so as to achieve an initial surface potential $V_o$, then, image formation is accomplished. In the region previously charged by the transfer charger 5, the first post-exposure potential $V_{i1}$ of the image region of the photosensitive member 1 becomes extremely low, such that the difference between $V_{i1}$ and subsequent postexposure potentials $V_{in}$ becomes quite large and exceeds 20 V. This difference in surface potentials results in image irregularities and defects between the first formed image and subsequently formed images.

Accordingly, the transfer charger 5 must be switched ON at the instant the region of the photosensitive member 1 that has been charged by the main charger 2 reaches the position of the transfer charger 5.

In the image forming apparatus of the present invention previously described, the photosensitive member is charged at least once by the main charger before electrophotographic image formation with reversal development is executed. The photosensitive member charged in this manner is then charged by the transfer charger with an opposite polarity to that of the main charger, then the photosensitive member is charged by the main charger with an opposite polarity to that of the transfer charger and image formation is then accomplished. Therefore, the post-exposure potential of the image region of the photosensitive member is considerably lower than in a conventional image forming method, from the start of image formation to allow a higher sensitivity of the photosensitive member to be maintained from the start of image formation. Repeated image formation produces only very slight variation in the sensitivity of the photosensitive member.

Accordingly, disadvantages of conventional methods arising from repeated image formation such as a gradual increase in the density of the formed image and a gradual increase of image line thickness are reduced, and uniform image production is stabilized.

In the present invention, before image formation the photosensitive member is charged by the main charger, then the charged region is again charged by the transfer charger with a charge of opposite polarity to that of the main charger without simultaneously switching ON the main charger and the transfer charger. Thus, the timing by which the main charger and the transfer charger are switched ON is staggered to produce uniform images.

Although the operation whereby, after photosensitive member 1 is charged by the main charger 2 prior to image formation, the charged region of the photosensitive member is subsequently again charged by the transfer charger with an opposite polarity to that of the main charger has been described in the present embodiment as a single operation said operation may be repeated more than once.

Further, while the photosensitive member 1 has been described in the present embodiment as being charged by the main charger 2 before image formation, the invention is not limited to this arrangement, and, for example, a separate means may be provided to charge the photosensitive member 1 with the same polarity as that of the main charger 2. Still further, although in the present embodiment the transfer charger 5 has been used as the means for imparting a charge of opposite polarity to that of the main charger 2, a separate means may be provided for that purpose, for example, a means for imparting an opposite-polarity charge may be disposed intermediately around the periphery of the photosensitive member 1.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic image forming apparatus with reversal development system comprising:

first charge means for charging a photosensitive member to first polarity;

second charge means provided at downstream side of said first charging means with respect to rotational direction of the photosensitive member and for charging the photosensitive member to second polarity opposite to said first polarity; and control means for controlling said first charge means to charge the photosensitive member to the first polarity and controlling said second charge means to charge the photosensitive member which is charged by said first charge means to the second polarity without operating an exposure means before image forming process with said reversal development.

2. The electrophotographic image forming apparatus as claimed in claim 1, wherein said first charge means is a main charger for charging the photosensitive member before exposing.

3. The electrophotographic image forming apparatus as claimed in claim 1 further comprising exposure means for exposing the photosensitive member so as to form a latent image thereon and developing means of said reversal development for developing the latent image, wherein said second charge means is a transfer charger for transferring the image developed by said developing means onto recording paper.

4. The electrophotographic image forming apparatus as claimed in claim 1, wherein said second charge means initiates its charging when the part of the photosensitive member which is charged by said first charge means reaches said second charge means.

5. The electrophotographic image forming apparatus as claimed in claim 1, wherein a plurality of latent images are formed in succession by said exposure means following the charging by said first and second charge means.

6. A method of forming images comprising the steps of:

(a) initially charging a photosensitive member to a first polarity which is followed by a charging of a second polarity opposite to said first polarity; and (b) forming an image thereafter on said photosensitive member by charging and exposing the photosensitive member to form a latent image and developing the latent image with reversal development.

7. An electrophotographic image forming apparatus comprising:

(a) a main charger for charging a photosensitive member to first polarity;

(b) exposure means for exposing the photosensitive member so as to form a latent image thereonto;

(c) developing means for developing the latent image formed by said exposure means with reversal development;

(d) a transfer charger for charging the photosensitive member to second polarity opposite to said first polarity and transferring developed image onto recording member; and (e) controlling means for controlling said main charger to charge the photosensitive member to the first polarity and controlling said transfer charger to charge the photosensitive member which is charged by said main charger to the second polarity prior to an image formation by said (a), (b), (c) and (d) means.

* * * * *